US005586761A

United States Patent [19]

Brock et al.

[11] Patent Number: 5,586,761

[45] Date of Patent: Dec. 24, 1996

[54] GOLF SWING TRAINING DEVICE

[76] Inventors: James H. Brock, 2055 Federal Rd., Roswell, Ga. 30075; Robert P. Foster, 1170 Harrowgrove Ct., Marietta, Ga. 30064

[21] Appl. No.: 296,969

[22] Filed: Aug. 26, 1994

[51] Int. Cl.[6] ..... A63B 69/36

[52] U.S. Cl. ..... 473/207; 473/276

[58] Field of Search ..... 273/187.2, 183 B, 273/188 R, 188 A, 189 R, 189 A, 190 R, 190 A, 183.1; 128/782; 482/123, 121, 126, 105

[56] References Cited

U.S. PATENT DOCUMENTS

| | | | |
|---|---|---|---|
| 1,530,519 | 3/1925 | Remington | 273/188 R |
| 4,326,718 | 4/1982 | Kiehl | 273/187.2 |
| 4,758,000 | 7/1988 | Cox | 273/190 A |
| 5,039,105 | 8/1991 | Ro | 273/187.2 |

FOREIGN PATENT DOCUMENTS

| | | | |
|---|---|---|---|
| 27103 | 11/1911 | United Kingdom | 273/188 R |

OTHER PUBLICATIONS

Research Disclosure S1830, dated Nov. 1991; Arm and Shoulder Motion Analyzers.

*Primary Examiner*—Vincent Millin
*Assistant Examiner*—Charles W. Anderson
*Attorney, Agent, or Firm*—Jones & Askew

[57] ABSTRACT

A golf swing training device includes an indicator rod mounted adjacent the golfer's shoulders by a shoulder mount and extends a predetermined distance from the golfer substantially perpendicular to an axis defined by the golfer's spine. The indicator rod is adapted to be guided by a guide member or structure supported adjacent the golfer so that as the golfer performs a golf swing the indicator rod engages and follows, but is not constrained by, the guide member or structure throughout the swing. The guide member or structure is effective to urge the indicator rod and thus the body movement of the golf in a preferred motion and to provide information regarding deviations from the desired swing. The information is provided by visual observation of the indicator rod and sound as the indicator rod movingly engages the guide member or structure.

6 Claims, 5 Drawing Sheets

GOLF SWING TRAINING DEVICE

TECHNICAL FIELD

The present invention relates to a golf swing training device and more particularly to a device and method for assisting a golfer in developing a proper golf swing.

BACKGROUND OF THE INVENTION

The game of golf is difficult to master. The golfer must learn and develop a fundamentally sound golf swing to achieve success. The golf swing is comprised of many components, including the stance or address position, the grip, the back swing, the downswing, the impact of the club to the ball, and the follow-through. Many of these components relate directly to the golfer's action of striking the ball with the club. More importantly, a golf swing includes the action of the golfer's large body muscles in effecting movement of the club. The proper motion of the golfer's shoulders, hips, arms, legs and torso are preferably choreographed so that the golfer achieves maximum distance and accuracy.

Of course, just as each golfer is different, each golfer will have unique elements in his or her golf swing. Nevertheless, superior golfers with superior golf swings show certain common swing characteristics. One such common characteristic is development of a consistent and optimal swing plane of the club which to a large extent results from turning of the shoulders on a plane perpendicular to the golfer's spine. The "correct swing" of a club is enhanced by consistently keeping the shoulders within the shoulder plane. If the shoulders are turned on the proper plane, the other parts of the golfer's body (i.e., hips, arms, hands) and the club will have a correspondingly greater likelihood of also reacting in the preferred manner. A second common characteristic of superior swings is the "coil-like" action of the golfer's body. As the superior golfer takes the club back, the golfer will coil in one direction thus building resistance or tension which is then released in the opposite direction in order to generate power and maximize shot distance. Yet another common characteristic of superior golf swings is their simplicity and resulting smooth tempo. Swings in which the golfer's body movements are coordinated or connected are much easier to repeat, and facilitate a smooth, even tempo.

A common difficulty caused by failing to execute a proper "on-plane" shoulder turn is referred to as a reverse weight shift. This swing defect may arise, for example, when the golfer begins to rotate on a substantially vertical axis during the back swing with the result that the golfer's weight is moved onto the golfer's front foot at the top of the back swing. The golfer's front shoulder is lowered, and therefore the golfer must make a dramatic "reverse" shift of weight onto the rear foot in order to strike the ball. As a result, the golfer fails to achieve the benefits of coiling or "uncoiling" the body with a resulting loss of both power and accuracy. A common difficulty caused by failing to properly make a full coil during a golf swing is an "arms-only" swing, which fails to maximize power and distance. Finally, if the various movements to be performed by the golfer are complicated or if movement of the various body parts become disconnected, the movements will be very difficult to repeat and will lack the smooth even tempo of a superior swing. Those of ordinary skill in the art recognize the problems associated with failing to base the swing on a proper coiling by rotating the shoulders on a proper plane, and a significant portion of the literature is directed to assisting golfers to correct these problems.

It is to be noted that others have addressed the issue of making a proper swing in a variety of contexts. One, for example, has emphasized lateral movement away from and then back in the direction of the golfer's target as a significant factor in producing a proper swing. A device directed to teaching this type of movement is shown in U.S. Pat. No. 5,050,885 to James T. Ballard, et al. Mr. Ballard is recognized as a leading proponent of this "lateral" type of body motion to effect a golf swing. Yet even this swing motion recognizes a combination of lateral and rotational motion to effect a modified coiling of the golfer's body. See, for example, U.S. Pat. No. 5,050,885, col. 2, lines 29–34.

Many devices have been provided for teaching a proper golf swing. Some of these devices include assemblies that may be attached to the golfer. U.S. Pat. No. 5,050,885, for example, describes a hip saddle that travels along a horizontal track which allows lateral movement. The saddle is attached to the horizontal track by a double-hinged movement, which also allows for rotational movement thereof. The golfer also wears a vest that facilitates learning of a golf swing in accordance with the patentee's swing philosophy.

Another example is shown in U.S. Pat. No. 4,758,000, issued to Cox. This patent discloses an apparatus including an elevated crank arm on which a shoulder guide is mounted. The shoulder guide directs the golfer's swing through a swing axis. The Cox device is thus effective to establish an interrelationship between the golfer and a swing plane, and then substantially maintain, by constraining the golfer's swing, that interrelationship during the swing.

A problem with many such devices is that they presume a "perfect" or "ideal" combination of movements necessary to make a perfect swing. While there may be general rules or even maxims applicable to developing a correct golf swing, it is necessary to realize that a correct golf swing is unique to each individual golfer. Any device that arbitrarily prescribes a particular combination of motions may in fact preclude an individual golfer from perfecting that individual's unique swing. This realization is borne out by the observation that many professional golfers have objectively different swings, yet each is clearly a superior golfer. More simply put, many prior art devices are based on a presumption that what works for one golfer works for all golfers. This simply is not the case.

Another problem with certain prior devices is that they tend to cause or dictate movement that neither are, nor feel natural to the golfer. Such movements are difficult to repeat once the golfer is free of the confines of the device. Another problem is that many of such devices may prevent or abbreviate a full, complete range of motion that must be experienced in order to develop the so-called muscle memory thought necessary for a proper swing (particularly in the follow-through). For example, some devices do not allow a full swing to be made because the mechanical structure of the device interferes with the back swing or the follow through. Others may not be suited to actually hitting a golf ball while simultaneously using the device. Such devices tend, alternatively, to emphasize a particular portion of the swing or just the initial stance or ball address. It is difficult, if not impossible, to achieve a proper golf swing by practicing a single component in isolation. Even if beneficial, any single component must be performed in combination and sequence with the other components. Practicing incomplete motions will prevent the development of full swing muscle memory which allows a golfer to repeat a swing in a consistent manner.

Other devices useful for golf swing training include devices that provide an indication of deviation from a desired swing movement but, by themselves, do not train total movement in the context of a complete golf swing. In U.S. Pat. No: 3,643,960, issued to Gentilly, a device for teaching a golfer proper head position during golf swings is disclosed. This device provides feedback information to indicate proper head position during the swing. Such devices are desirable in that they allow development of an individual's swing without the constraints prescribed by other devices. Such devices are nonetheless limited essentially in their use. For example, Gentilly provides training limited essentially to the chin position of the golfer during the swing. More particularly, this reference assists a golfer in learning to keep the head in a "still" position when swinging the golf club. This device constrains movement of the head; it does not encourage proper movement throughout an entire actual swing. Other devices are not motion limiting but fail to provide feedback to tell the user when the user deviates from a desired swing. Other non-constraining devices may similarly allow practice of only a portion of the entire swing, thereby preventing the development of muscle memory necessary to develop the entire golf swing, including the shoulder turn.

U.S. Pat. No. 5,039,105, issued Aug. 13, 1991 to Ro, discloses a golf training apparatus having a shoulder guide and a hand guide with seven different subassemblies. One embodiment includes an extension member that may interfere with the golfer's swing and would impede visual sight of the golf ball. Another embodiment includes a hand guide unit that contacts the golf club. Neither embodiment contemplates a complete and full swing to strike an actual golf ball, nor a member to guide the shoulders in a proper plane during a swing.

Yet another training device is shown in U.S. Pat. No. 4,318,546, issued to Chen. This patent discloses an apparatus that essentially forces a golfer to follow a fixed and constant swing path. This apparatus includes a shoulder holding device and a waist holding member that guides or restricts the golfer's shoulders and waist, respectively, to always turn around a substantially fixed axis without being permitted to move in an upward, downward, leftward or rightward direction when swinging the club. The Chen apparatus is thus to be distinguished from those that are not constricting, but it nonetheless fails to accommodate the unique swing characteristics of many golfers.

Additionally, many of the prior art training devices, including those discussed above, tend to be expensive and mechanically complex, making them difficult to set up and use. Such devices are oftentimes quite large, thus preventing them from being transported conveniently. A preferred golf swing training device utilizes a minimum number of parts to facilitate maintenance and to increase longevity. An ideal practice tool could be transported as an accessory and would be as small in size and as lightweight as possible. Such a device could be easily set up and used, disassembled after training, and then stored with the golfer's clubs.

The prior art therefore lacks a golf swing training device for teaching the essential elements of a proper golf swing on an individualized basis that is inexpensive, not mechanically complex, and easy to setup, transport and store. The prior art further lacks a golf swing training device that assists the golfer in developing a proper "on-plane" coiling or turn of the shoulders by guiding the golfer and alerting the golfer to improper movement, without constraining body motion. The prior art further lacks a golf swing training device that provides feedback in real time to the golfer to indicate undesirable deviations from a proper swing while the golfer is actually striking a golf ball. The prior art further lacks a golf swing training device that is non-constraining and that encourages the golfer to develop the primary elements of a simple, connected golf swing in the context of making full swings and striking golf balls.

SUMMARY OF THE PRESENT INVENTION

The foregoing problems of the prior art have been overcome by the golf training device of the present invention. The golf training device of the present invention assists a golfer in learning a proper golf swing by guiding, and providing characteristic information about, the golfer's relative body motions in relation to a guide. The present invention guides the golfer in making a proper "on-plane" shoulder turn and coil. The present invention therefore trains a golfer in certain basic, related or connected movements so as to develop the necessary muscle memory to repeat a proper golf swing. The present invention recognizes and accommodates an individual golfer's unique swing elements while teaching common characteristics of superior golf swings. The present invention does not constrain a golfer's swing, and in fact permits and encourages the full range of proper movements for striking a golf ball. The present invention alerts the golfer to improper swing deviations and provides a mechanism for curing such deviations. This alert is provided in real time as the golfer practices using the present invention. The present invention is readily transported, set up, disassembled and stored, and its preferred construction is sensitive to costing and other manufacturing concerns.

Generally described, a golf swing training device according to the present invention comprises a fixed guide member, and an indicator in operative association with the guide member. In its preferred embodiment, the indicator denotes the instantaneous position of the golfer's shoulders relative to the guide member while a golfer is swinging a golf club. In the event of an improper movement of the shoulders or an excess raising of either the leading arm or both of the arms, the golfer is alerted thereto as a result of the interaction between the indicator and the guide member or the indicator and the golfer's arms. Once the golfer has learned his or her proper shoulder turn plane, the golfer may rely solely on the indicator as it reflects shoulder rotation and can be viewed by the golfer while making a golf swing.

Described somewhat more particularly, a preferred embodiment of the present invention comprises a base that supports a guide member. The base may be placed directly on the ground or other surface from which a golf ball is to be struck by a golfer. The base is adjustable such that the guide member may be raised or lowered depending on the golfer's height or preference. The guide member is mounted upon the base. The guide member may be pivoted at various degrees of deviation from horizontal so as to define or reflect the individual golfer's preferred body movements and shoulder swing plane when swinging each of the different length and lie clubs used in the game of golf. The golfer is fitted with an indicator. The preferred indicator extends from the golfer a sufficient distance such that, when the golfer is using the device, the distal end of the indicator rests on top of the guide member. The preferred indicator crosses the golfer's upper chest in a horizontal plane, such that when viewed face on, the indicator appears to cross the chest at slightly below the top of the shoulders. The distal end of the indicator extends outward to the side of the golfer, points in the direction of the preferred ball flight and engages the guide. By viewing the indicator and its relationship with the guide, the golfer can make sure his shoulders are in proper alignment at address of the ball. The golfer can also align his feet and hips by viewing their relationship to the base. As the golfer performs the back swing, the indicator moves along the guide in order to provide information pertaining to the golfer's shoulder rotation. As the indicator traverses the guide member, the golfer can hear the physical interaction therebetween and preferably see the indicator in its relationship to the guide or the base. At the completion of the back swing, the golfer reverses the swing and correspondingly the direction of the indicator or the guide member, thereby executing the remaining swing components, including striking the ball.

If the golfer performs a proper shoulder turn, the present invention will recognize such by providing a constant level of affirmative indicia (for example, the sound of the indicator moving on the guide member and the visual feedback of the indicator moving across the guide, or in its relationship to the base). If the golfer deviates from a proper swing by dropping the front shoulder, the golfer is alerted thereto by the resistance of the indicator flexing against the guide member. As the level of deviation from a proper plane increases, the indicator contains a secondary sound device which can be set to alert the golfer to various levels of deviation. If the golfer deviates from a proper swing by raising the front shoulder, the indicator is removed from the guide member and sound of the indicator and resistance against the guide member is lost. Additionally, if the golfer raises his arms away from his body, the indicator will provide resistance, and if the arms are raised excessively, the same secondary alert device will be activated as the arms act to raise the indicator.

Described a bit more particularly, a preferred embodiment of the present invention comprises a vest or harness from which extends an indicator. The vest or harness fits about a golfer using the invention. The indicator may comprise a rod or other signaling device. The indicator is aligned substantially parallel with the golfer's shoulders such that, when addressing the golf ball, the indicator projects from the golfer in the direction of the golfer's target. The indicator is of sufficient length to engage the guide member. The preferred guide member is shaped as a semi-loop or elliptical arc that partially encircles the front and side of the golfer so as to define or reflect that golfer's particular physical structure. The golf ball to be struck is placed near the base that supports the guide member. The guide member may be adjusted as needed depending upon and in response to a particular golfer's height, shoulder plane according to that golfer's individual swing characteristics, and to that golfer's preferred shoulder plane for any particular club length.

Once adjusted, the guide member is substantially stationary and establishes a framework to guide the golfer in making a proper swing. The indicator rests on top of the guide member when the golfer addresses the ball. As the golfer executes first a back swing and then rotates the shoulders back from the address position, the indicator skims the top of the guide member, thus providing both visual and auditory information to the golfer. As the golfer strikes the ball and performs the remainder of the follow-through, the indicator disengages from contact with the guide member so that the golfer may complete the swing. The golfer is informed of excessive deviations from a proper shoulder turn by an alarm such as a bell or buzzer in operative association with the indicator, as well as by resistance of the indicator against the guide member. Sufficient vertical movement of the indicator, caused by depression of the indicator against the guide member, results in sounding of the alarm. In that event, the golfer is informed that he or she has performed an improper body movement as in, for example, a reverse weight shift such that the golfer's weight has not been properly transferred during the swing. Repeated use of the preferred embodiment addresses this problem and, over time, facilitates a cure thereof and assists the golfer in learning the necessary muscle memory to develop a proper swing.

The preferred method of the present invention includes providing an indicator in substantially parallel engagement with the shoulders of the golfer, and providing a guide member reflective of the proper body movement for that golfer. The golfer may visually observe the indicator while swinging a club and striking the ball. By visually observing the indicator, the golfer can more easily judge whether a proper body movement has been made. The golfer may also hear the indicator skimming the guide member during the swing so as to obtain auditory information pertaining to the rotation of the golfer's body while swinging the club, and thereby establish a proper tempo. The guide preferably includes a straight (non-curved) segment which is aligned directly with the target. By aligning the indicator parallel to the guide, the golfer can insure that his shoulders are in proper alignment.

The present invention may further include a base member that assists a golfer in learning proper stance and alignment. Indicia may be provided on the base member to provide information pertaining to the width of the golfer's stance and the golfer's alignment relative to a target. The base member may also provide indicia corresponding to the golfer's shoulder rotation so that a user of the present invention can determine how far he or she is rotating the shoulders when making a golf swing.

The present invention may yet further include an indicator which branches to form two prongs, one of which runs above the guide and one below. The lower prong of such an indicator would provide physical resistance against the golfer's shoulders becoming too horizontal during a swing, in addition to the upper prong prohibiting the shoulders from becoming too vertical.

Thus, it is an object of the present invention to provide a golf swing training device.

It is a further object of the present invention to provide a golf swing training device that recognizes and accommodates the unique golf swing characteristics of individuals.

It is a further object of the present invention to provide an adjustable golf swing training device.

It is a further object of the present invention to provide a golf swing training device that allows a user to strike a golf ball while using the apparatus.

It is a further object of the present invention to provide a golf swing training device that allows the user to make a complete golf swing.

It is a further object of the present invention to provide a golf swing training device that instantaneously tracks the golfer's body rotational movements.

It is a further object of the present invention to provide a golf swing training device that informs the golfer of swing deviations.

It is a further object of the present invention to provide a golf swing training device that provides both visual and auditory information to a user.

It is a further object of the present invention to provide a golf swing training device that informs the golfer of improper shoulder movements.

It is a further object of the present invention to provide a golf swing training device that guides a golfer to make a proper or "on-plane" shoulder turn.

It is a yet further object of the present invention to provide a golf swing training device capable of being adjusted to differing golfer's individual body movements and characteristics.

It is a still further object of the present invention to provide a golf swing training device that can be readily assembled, disassembled, stored and transported.

It is a further object of the present invention to provide a visual means of body alignment and stance position for the golfer.

It is a further object of the present invention to provide a means for assisting the golfer in obtaining proper tempo during a golf swing.

It is a further object of the present invention to assist the golfer in maintaining "connection" between the arms and the body so as to facilitate a "one-piece take away" of the club from the ball, and so as to facilitate connection between the arms and body throughout the swing.

It is a still further object of the present invention to assist the golfer in developing a simple, more powerful, more easily repeated swing.

It is a further object of the present invention to provide a mechanical device which will significantly aid teaching professionals in giving lessons to students.

It is a further object of the present invention to provide a device which is helpful to golfers who wish to improve their swings through self-taught methods.

It is a further object of the present invention to provide a golf training device which is weather resistant, and usable in a wide variety of environments.

It is a still further object of the present invention to provide a golf swing training device that is economical to manufacture and maintain.

It is a still further object of the present invention to provide a method for training a golfer to properly swing a golf club.

Other objects and features of the present invention will be readily understood from the following detailed description of specific embodiments thereof when read in conjunction with the accompanying drawings.

DETAILED DESCRIPTION OF THE PREFERRED EMBODIMENT

Figure 1:
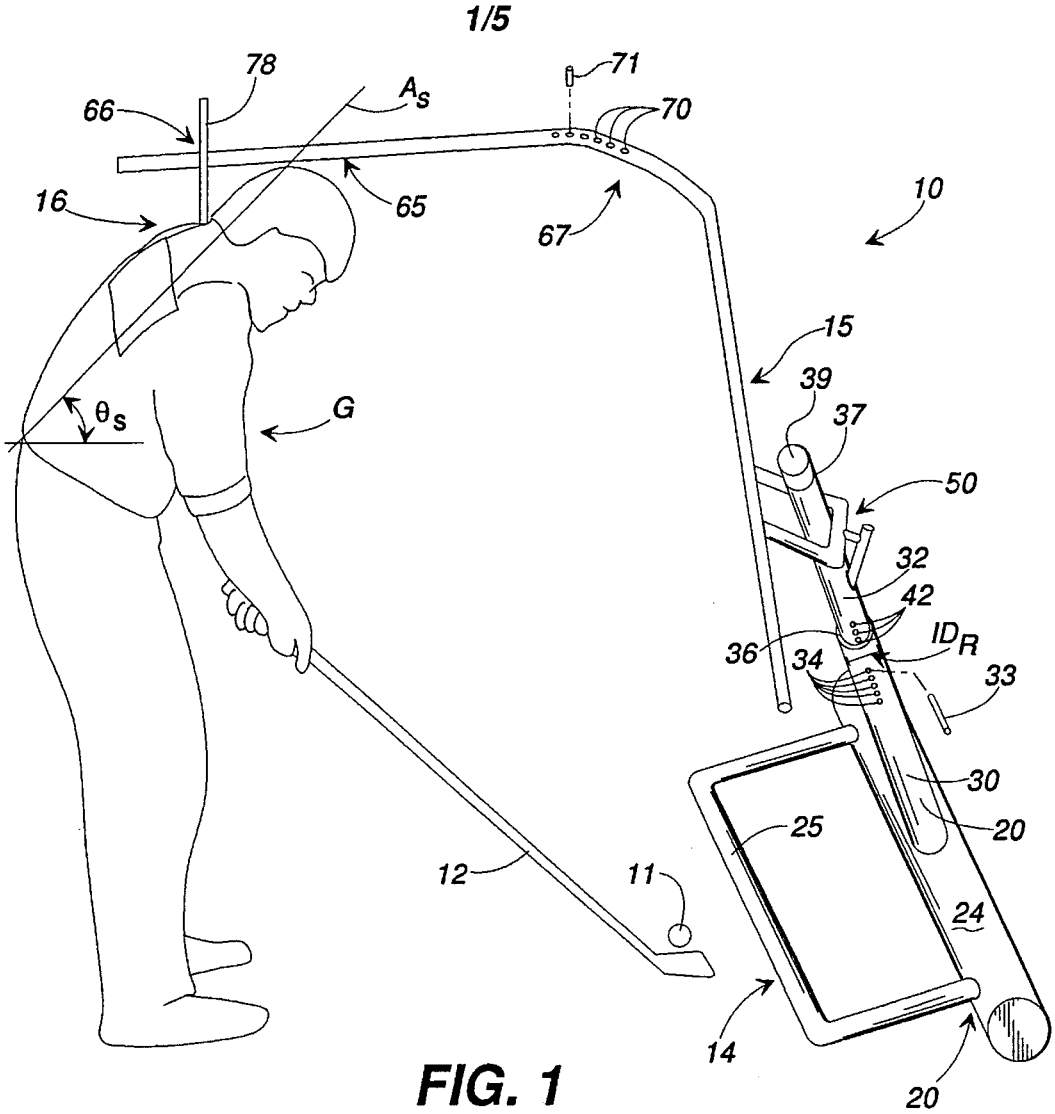
FIG. 1 is a perspective view of the preferred embodiment of the golf training device of the present invention showing a golfer poised in an initial position.

Referring to the drawing figures, in which like numerals indicate like parts throughout the several views, FIG. 1 shows a preferred embodiment of a golf training device in accordance with the present invention generally designated by the numeral 10. The device 10 is shown in use by a golfer G poised to strike a golf ball 11 by manipulating golf dub 12. An imaginary axis of shoulder rotation As is defined generally through the spinal column of the golfer G and inclined at spine angle $Ø_s$ relative to the ground. The golfer's back is angled and the knees are slightly bent as is common. The device 10 generally includes a base assembly 14, a swing guide assembly 15 supported by the base assembly and an indicator assembly 16 to guide, but not constrain the movement of, the golfer G through a proper swing and to provide information and feedback regarding the characteristics of the golfer's swing in real time.

The base assembly 14 shown in FIG. 1 includes a foot 20 and a telescoping leg 22. The leg 22 is supported on and extends upward from the foot 20. The foot 20 includes an elongated tubular pedestal 24 and an outrigger 25. The pedestal 24 is preferably made of a polyvinyl chloride (PVC) material and may be, for example, four inches (4") in diameter. Those skilled in the art will appreciate that any suitably rigid material may be utilized. The pedestal 24 is hollow and may be formed integrally with the outrigger 25. As explained in greater detail below, the outrigger 25 is generally "U" shaped and provides a convenient handle for carrying and storing the apparatus 10. In use, the outrigger 25 provides stability and prevents tipping of the apparatus 10 in a direction towards the golfer G.

The telescoping leg 22 is comprised of a receiving cylinder 30, a projecting cylinder 32 and a retaining pin 33. The receiving cylinder 30 is mounted on the tubular pedestal 24. The preferred cylinder 30 is hollow, yet made of a sufficiently rigid material to support the swing guide assembly 15. The receiving cylinder 30 may be made of PVC, but any other suitable material, including metal, plastic or the like may be used. The receiving cylinder 30 defines an inside diameter $ID_r$ of sufficient dimension to receive the projecting cylinder 32. A plurality of spaced openings 34 are defined in the lower cylinder 30. These openings 34 are of sufficient diameter to receive the retaining pin 33 and facilitate vertical adjustment and positioning of the swing guide assembly 15 as set forth below.

The projecting cylinder 32 is hollow and of a diameter operatively less than $ID_r$. The projecting cylinder 32 defines a lower end 36 and an upper end 37. The lower end 36 is sized to be telescopically received by the receiving cylinder 30 to effect the arrangement shown in FIG. 1. The projecting cylinder 32 is preferably made of PVC, or any other material suitably rigid to support the swing guide assembly 15. The upper end 37 of the projecting cylinder 32 is fitted with a cap 39. The cap 39 prevents the intrusion of water or dirt into the projecting cylinder. If desired, the receiving cylinder 30 may be fitted with an O-ring or like detent (not shown) that prevents intrusion of water or dirt into the hollow core of the receiving cylinder. In a manner similar to that of the receiving cylinder 30, the projecting cylinder 32 defines a plurality of spaced openings 42 that, like the openings 34, are of sufficient diameter to receive the retaining pin 33. It will be appreciated that the height of the telescoping leg 22 may be fixed by causing an opening 34 and an opening 42 to be aligned with one another by moving the projecting cylinder 32 coaxially within the receiving cylinder 30. The pin 33 is inserted through the openings 34 and 42 to fix the position of the projecting cylinder 32 with respect to the receiving cylinder 30. The openings 34 and 42 may be arranged along the respective cylinders 30 and 32 so that a portion of the projecting cylinder always resides within the receiving cylinder to thereby insure that the leg assembly 22 is stable at any effective height.

It will be appreciated by those skilled in the art to which the invention pertains that other telescoping leg arrangements and height adjustment mechanisms may be used. Alternative arrangements may include, for example, a projecting cylinder 32 of greater diameter than the receiving cylinder 30 so as to be slid along the outside surface of the receiving cylinder 30. Alternative means for securing the height may include, for example, a compression fitting adapted to the distal end of the receiving cylinder 30 that includes a resilient and deformable ferrule. When the compression fitting is tightened, the deformable ferrule is correspondingly tightened so as to immobilize the projecting cylinder with respect to the receiving cylinder 30.

The lengths of the receiving cylinder 30 and projecting cylinder 32 preferably provide a desirable height adjustment range so that the device 10 is usable by many different golfers.

Figure 5:
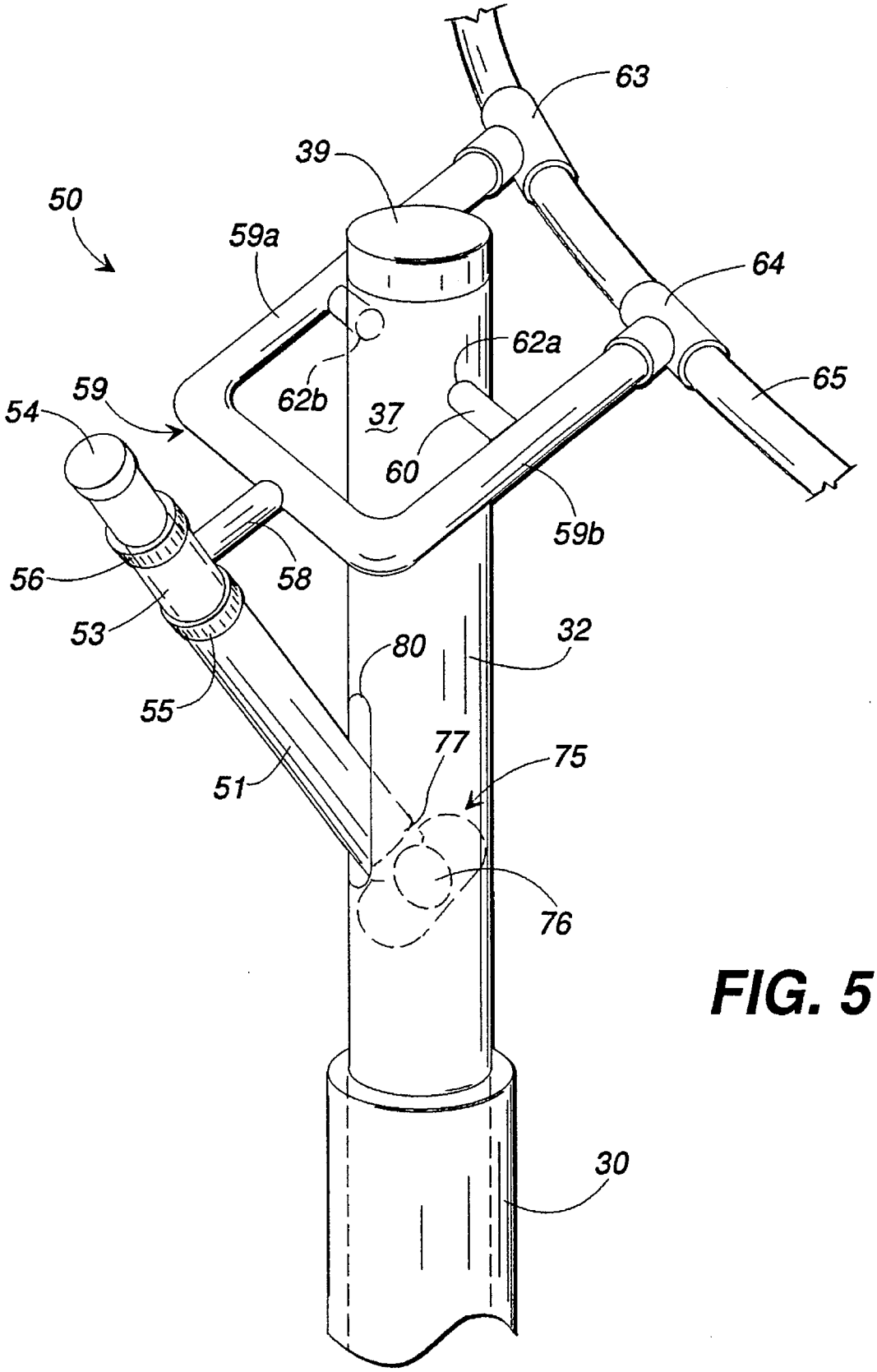
FIG. 5 is a perspective view of the guide loop adjustment fixture shown in FIG. 1.

An adjustment fixture 50, which is shown in greater detail in FIG. 5, is disposed adjacent the upper end 37 of the telescoping projecting cylinder 30. The fixture 50 is effective to maintain a desired orientation of the swing guide assembly 15 relative to the golfer G. The fixture 50 includes an adjustment bar 51. One end of the bar 51 is secured to the projecting cylinder 32 by means of a rotating joint 75 including a mounting rod 76 secured within said projecting cylinder 32 and a fitting 77 about said rod 76 The bar 51 passes through a slot 80 defined in the projecting cylinder 30. It is to be understood that adjustment of the fixture 50 as described below will cause the bar 51 to travel in said slot 80. The details of such a connection are within the purview of one of ordinary skill in the art. It will be appreciated that when the cylinder 32 is raised or lowered, the bar 51 is likewise raised and lowered. A fitting 53 is secured about the bar 51. The fitting 53 is telescopically adjustable along the bar 51. A cap 54 is provided at the distal end of the bar 51. The cap 54 precludes movement of the fitting 53 beyond the distal end point of the bar 51. The projecting cylinder 32 limits movement of the fitting at the other end of the bar 51. The bar 51 and fitting 53 are preferably made of PVC, although any suitably rigid material may be used. To permit and facilitate adjustment of the fitting 53, two rotatable compression fittings 55 and 56 are provided to secure the fitting 51 in any desired place along the bar 51. Thus, it is to be understood that the fitting 53 may be either extended from or retracted toward the cylinder 32. Such movement of the fitting 53 results in an adjustment of the swing assembly 15 as described below. At any position on the bar 51, manipulation of the compression fittings 55 and 56 secures the fitting 53.

The fitting 53 includes a projection. 58 that is integrally formed with a pivotable, U-shaped mounting shoe 59. The fitting 53 and the projection 58 may be formed integrally, or secured together in any acceptable manner. When the fitting 53 is extended or retracted, this movement translates into a rotational movement of the shoe 59. The shoe 59 defines two arms **59*a* and 59*b* that pass on either side of the cylinder 32 to support the swing guide. Such movement of the shoe 59 is produced, in part, by means of a pivot bar 60. The pivot bar 60 may be made of any suitable material, although PVC is preferred. The pivot bar 60 is fixedly secured to or integrally formed at its ends with the shoe arms 59*a* and 59*b*. The pivot bar 60 passes through a pair of apertures 62*a* and 62*b* defined in opposing side walls of the projecting cylinder 32. The ends of the shoe 59 terminates in two fixed fittings 63 and 64 that are secured below and support a swing guide 65. It is to be understood that movement of the fitting 53 along the bar 51 causes that portion of the projection 58 to move closer to or further from the cylinder 32. Movement of the fitting 53, in turn, causes the shoe 59 to pivot about the pivot bar 60**, thus adjusting the position of the swing guide assembly as described in greater detail below.

Figure 8:
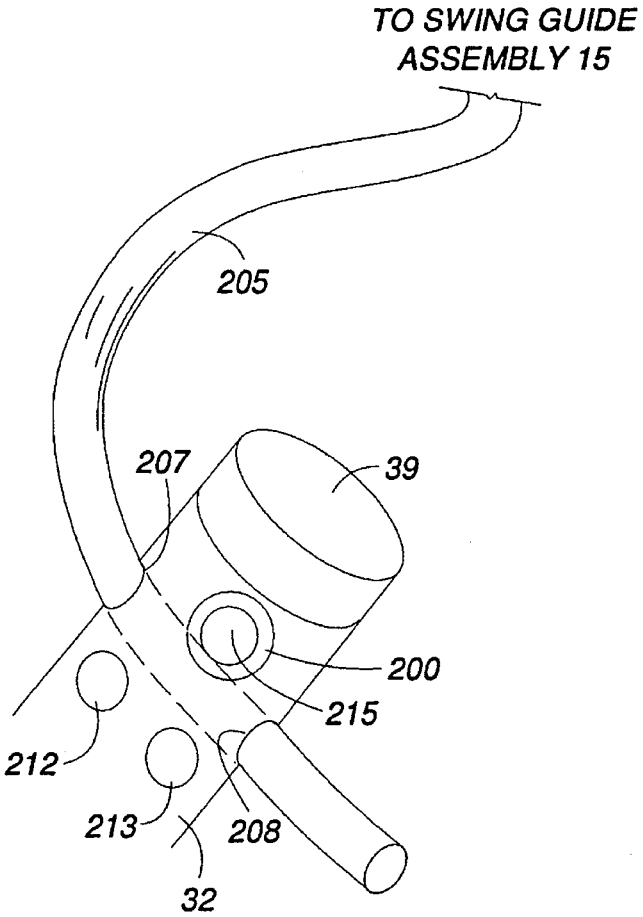
FIG. 8 is a schematic view of an alternative construction of a mounting of the extension arm of the preferred embodiment, for adjusting the angle of the guide loop.

It is to be understood that the angle of the swing guide assembly 15 may be adjusted utilizing different adjustment devices. For example, referring in detail to FIG. 8, an alternative "dial" type construction is shown that facilitates adjustment of the angle and height of the swing guide assembly 15 by a single dial 200. In this alternative embodiment, the swing guide assembly 15 is secured in a suitable manner to a curved support member 205. The support member 205 may be made of PVC or any other material suitable to support the swing guide assembly 15 and accomplish the other features of this embodiment. The support member 205 is connected at one end to the swing guide assembly 15. The support member 205 slidably extends through two aligned apertures 207 and 208 in the projecting cylinder 30.

The curved support member 205 is supported by two rotatable rollers 212 and 213 mounted wholly within the projecting cylinder 30. The curved support member 205 is further supported by a third rotatable roller 215 that rests on top of the support member. The third rotatable roller 215 is fixedly secured to or integrally formed with the dial 200 that is located on the exterior of the projecting cylinder 30. Thus, it is to be understood that rotation of the dial 200 effects simultaneous and like rotation of the third rotatable roller 215. Accordingly, as the dial 200 is turned in a counterclockwise direction, the third rotatable roller 215 is likewise turned in a counterclockwise direction. Because the roller 215 frictionally engages the top of the support member 200, the support member 200, the support member is pulled through the apertures 207 and 208 to thereby lower the swing guide assembly 15. In like manner, the dial 200 may be rotated in a clockwise manner to raise the position of the swing guide assembly 15.

Further, because the support member 205 is curved as shown in the representative drawing, the angle of the guide member 65 (described in detail hereinbelow) is also adjusted. For example, a counterclockwise rotation of the dial 200 increases the angle of the guide member 65 to something approaching vertical. The length and degree of support member 205 curvature are preferably coordinated so that the angle and height of the guide member 65 may be changed simultaneously to correspond to changes in a golfer's spine angle resulting from normal play of different length golf clubs. (It is recognized that, for example, a "9" iron is shorter in length than a "5" iron, which is shorter in length than a "2" iron. As a result, the golfer's spine angle changes; the typical golfer is bent over more to hit with a "9" iron than a "2" iron.) The details of such a dial construction are believed to be well within the purview of one of ordinary skill.

The swing guide assembly 15 includes a swing guide member 65. The guide member 65 is preferably an extended, rigid and unitary structure of a generally circular cross-section. The guide member 65 may be fabricated of PVC or any suitable material, including, for example, extruded aluminum tubing. The guide member 65 defines an address position 66, and a swing section 67, and a back swing section 68. The address position 66 delineates the position at which the golfer G first readies himself or herself to swing the club 12. The back swing portion 68 delineates the position where the golfer G's shoulders and hips are turned in making the back swing. The swing section 67 represents that portion of the guide member 65 defined as that portion between the address position 66 and the back swing position 68. It is to be understood that the address position 66, the swing section 67 and the back swing position 68 will vary from golfer to golfer. The preferred guide member 65 is further characterized by a plurality of apertures 70 arranged along the upper surface of the swing region 67. The apertures 70 are spaced approximately one inch apart; however, any convenient spacing is allowable. The apertures 70 are adapted to receive a single pin 71 therein. The post pin 71 serves to indicate hyperextension during the golfer's back swing, as will be more thoroughly explained hereinbelow.

Figure 2:
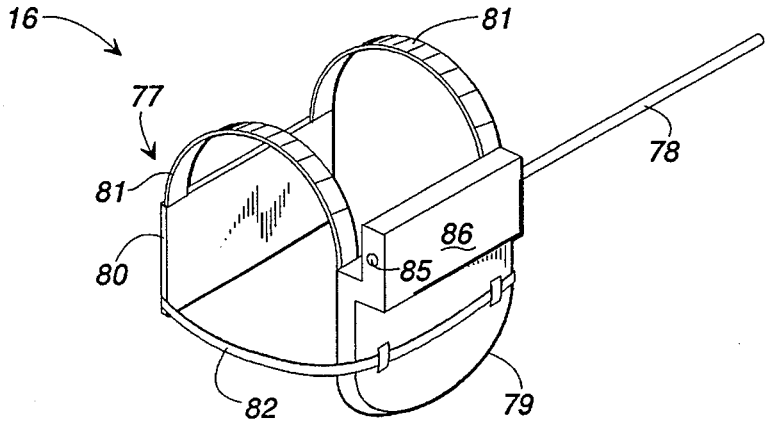
FIG. 2 is a perspective view of the vest and indicator rod.
Figure 3:
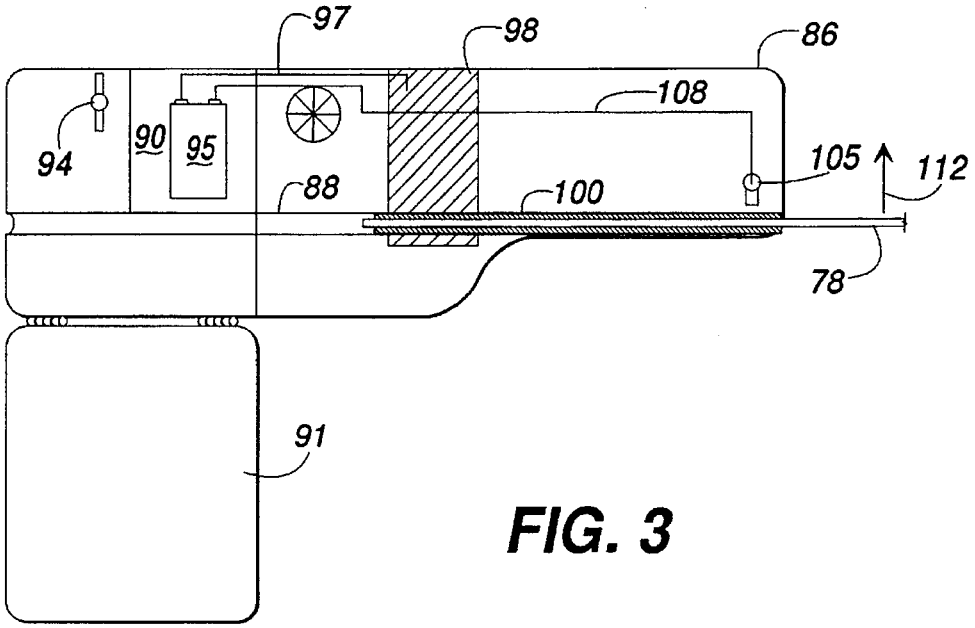
FIG. 3 is a front elevational view of the indicator rod and vest construction.

The indicator assembly 16 of the present invention is shown in FIG. 2. The indicator assembly is characterized by a vest/harness 77 and an indicator rod 78 projecting from the shoulder thereof. The vest 77 is configured to be worn by the golfer G, and includes a front chest pad 79 and a back pad 80. The pads 79 and 80 are spaced apart one from the other, but connected by a pair of straps 81 so as to be maintained in substantially parallel relationship. The straps 81 are preferably made of a material sturdy enough to withstand repeated wear, but flexible enough to permit the golfer G to freely swing the club 12. The vest 77 further includes a securing strap 82 that wraps around the golfer G's front chest pad 79 and the back pad 80 to secure the vest 77 about the golfer's shoulders and upper body. The ends of the securing strap 82 may be secured adjacent the chest pad 79 by conventional means including, for example, a buckle or cooperating. hook and loop fasteners commonly referred to as "Velcro" fasteners. The front chest pad 79 includes an indicator rod mounting bracket 85. The bracket 85 is shown in FIG. 3. The bracket 85 has a rectangular block 86. The block 86 may be made of wood or any other nonconductive material and defines a channel 88 that receives the indicator rod 78. The channel 88 is of slightly lesser depth than the diameter of the rod 78, such that a flat object placed over the channel when the rod is in place would prohibit the rod from moving. The block 86 defines a cavity (described below) that is covered by a door 91. The door 91 can be tightened over the channel 88 by a wing nut 94 which, when rotated into an appropriate position, clamps the door into place above the channel 88.

The block 86 further defines a cavity 90 which is of sufficient dimension to receive and retain a power source 95. An alternative preferred embodiment provides a hinged door that covers a cavity for receipt of a power source. Such modifications are within the purview of one of ordinary skill in the art. While many different power sources may be used, a preferred source is a nine volt (9 V) battery. The battery 95 shown in FIG. 3 is electrically connected to the indicator rod 78 as described herein. The battery 95 is connected by a wire 97 to a conductive plate 98. The plate 98 may be made of copper or any other electrically conductive material. The plate 98 extends from the top of the block 86 to below the level of the indicator rod receiving channel 88. When inserted in the channel 88, the indicator rod 78 contacts the conductive plate 98. The portion of the indicator rod 78 that contacts the conductive plate 98 is covered in a conductive material or sheath 100. The conductive sheath 100 may also be made of copper and extends from one side of the conductive plate 98 to nearly the right or forward end of the block 86.

The block 86 also includes an electrically-charged detent 105. The detent 105 is preferably an inverted L-shaped bracket that is configured to engage or "catch" indicator rod 78. The detent 105 is electrically connected to the battery 95 by a wire 108. Wire 108 is, in turn, connected to a buzzer 110 that is mounted on the block 86. The indicator rod 78 is preferably retained in the channel 88 by means of a friction fit so that, if desired, the rod may be readily removed. The indicator rod 78 is preferably made of a material that is sufficiently flexible so as to permit ½" to 1" of travel or flex at the location indicated by the arrow 112. Since the rod 78 acts as a guide, it should be primarily rigid and any flexibility beyond that noted above is not desirable. This flexibility at point 112 permits the indicator rod 78 to be deflected up or down at the location of the detent 105. It is to be understood that, if the indicator rod 78 is deflected upwardly to engage the detent 105, a circuit is completed that instantaneously engages the alarm 110.

Figure 4:
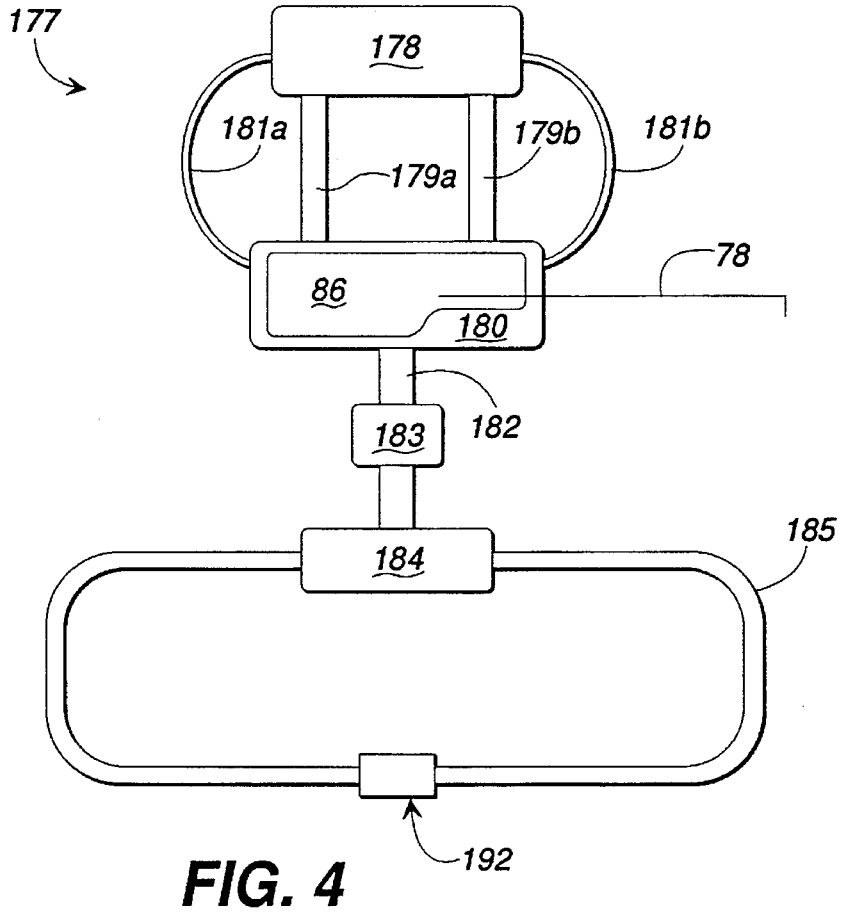
FIG. 4 is a perspective view of an alternative vest and harness construction in accordance with the present invention.
Figure 4A:
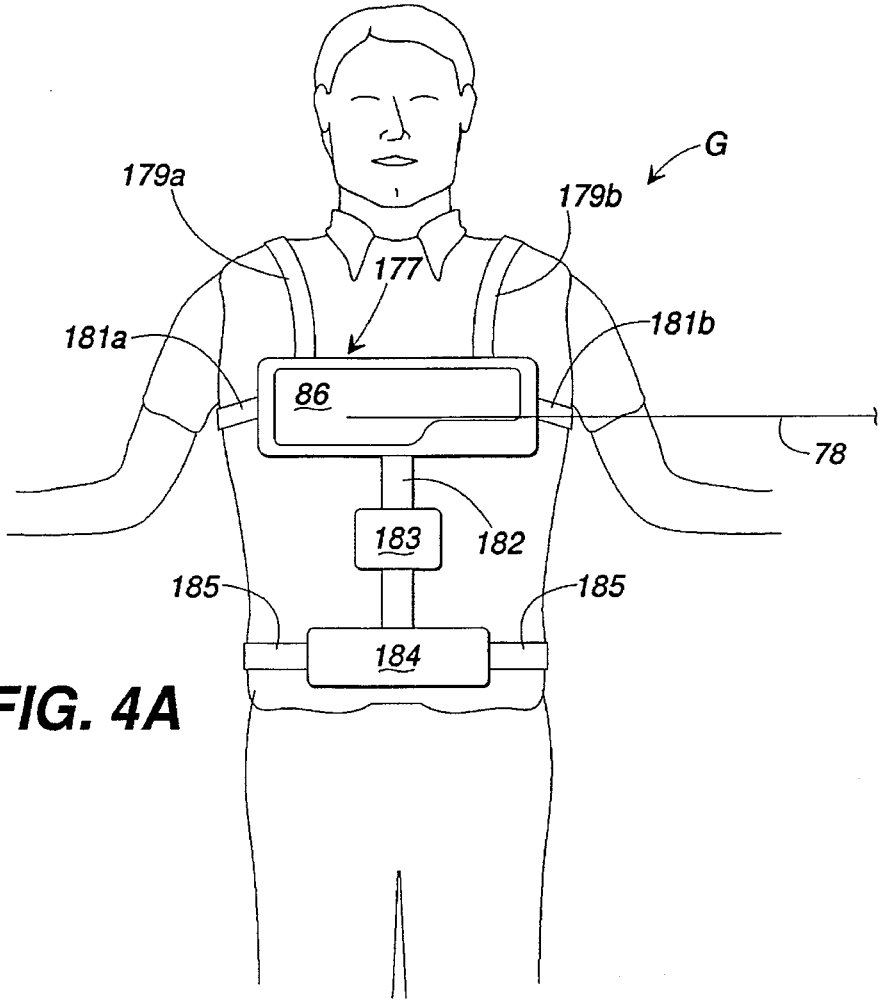
FIG. 4A is a front plan view of the embodiment shown in FIG. 4 as worn by a golfer.

In its preferred form, the vest 77 places the indicator rod 78 at or near the location of the golfer G's collarbone. The vest 77 is therefore adjustable because golfers vary in body configuration. An alternative vest 177 is shown in FIG. 4, which includes a back pad 178, two shoulder straps **179*a* and 179*b*, the front pad 180 with block 86 and indicator rod 78, an adjustment bar 182 with an adjusting mechanism 183, and a waist pad 184. The waist pad 184 is held in place by a strap which fits around the golfer's (G) waist 185. The strap acts as a belt, and includes a buckle-type arrangement or velcro fastener area 192. The front pad 180 and the back pad 178 are connected by belt straps 181*a* and 181*b*. FIG. 4A shows the alternative vest 177** as worn by golfer G.

The indicator rod 78 is preferably a unitary, tubular or round solid member of lightweight construction. A preferred material is phenolic foam, although any other suitable material may be used. The rod 78 must be of sufficient length to permit a golfer G to stand adjacent the foot 20 as shown in FIG. 1 and engage the indicator rod 78 to the guide member 65.

The invention 10 is used by the golfer G first donning the indicator assembly 16. Where the golfer G is right-handed, as shown in FIG. 1, the indicator rod 78 will extend across the golfer's chest beyond the golfer's left shoulder. For left-handed golfers, the indicator rod 78 extends across the right shoulder, and the guide member will likewise be reversed. The golfer G places the ball 11 along side the outrigger 25 and addresses the ball in the conventional fashion. At this stage, the indicator rod 78 rests upon the top of the guide member 65 at the address position 66. If the guide member 65 is too high, the golfer G may lower the guide member by manipulation of the telescoping leg assembly 22. The leg assembly 22 is directed essentially at vertical adjustment. In other words, the height of the swing guide assembly 15 may be set to accommodate the golfer's particular height by setting the height of the telescoping post assembly 22. The height of the post assembly 22 is set by causing the telescoping projecting cylinder 32 to extend from the receiving cylinder 30 and securing it thereat by aligning the openings 34 and 42 and inserting the adjusting pin therethrough. Those that play the game of golf will appreciate that the golf swing is not performed in a horizontal plane. Thus, the fixture 50 may be adjusted to match the vertical extent of the particular golfer's shoulder angle by manipulation of the fitting 51. The golfer G may set the guide member 65 angle by standing adjacent the device 10 and loosening the compression fittings 55 and 56, and adjusting the fitting 51 to correspondingly adjust the guide member 65. In this fashion, the apparatus 10 permits the golfer to assume his or her individual address position with the proper spine angle $A_s$. The indicator rod 78 rests on the guide member 65. The golfer G then executes the back swing with the club 12 while keeping his or her spine angle $A_s$ constant. This motion in turn causes the indicator rod to move along the guide while maintaining a proper relationship with the golfer's spine. If a proper back swing is made, the indicator rod 78 contacts the guide member 65 throughout the back swing but the pressure exerted on the guide member 65 by the rod 78 is not sufficient to activate the buzzer 110. However, if the golfer G deviates from the proper swing such that the pressure exerted against the guide member 65 by the indicator rod 78 is sufficient to cause the rod to contact the detent 105, the buzzer 110 is activated and the golfer G is made aware of the deviation.

The golfer G then practices proper shoulder and hip turns by repeatedly addressing and striking golf balls 11. Such practice causes the indicator rod 78 to traverse the guide member 65. The movement of the indicator rod 78 across the guide member 65 provides variable audible feedback. First, the quality of the sound produced by the motion of the rod 78 traversing the guide member 65 depends on the speed at which the indicator rod 78 moves. This speed directly correlates to the speed of the golfer's swing. Inconsistency in swing motion will cause the sound's frequency to vary and the golfer will be informed of such inconsistency. The amount of pressure exerted by the indicator rod 78 on the surface 68 will cause the sound's volume to vary. If the golfer G raises his spine angle at any time during the swing, there will be variations in the volume throughout the swing due to lower pressure on the guide member 65 by the rod indicator 78. If the golfer G lowers his spine angle the volume will increase. What is desirable is a smooth, constant volume slicing noise or "swoosh" as the indicator rod 78 traverses the guide surface 68. By consistently using the device 10 a golfer will develop the muscle memory necessary to have a proper shoulder turn on both the back and forward swings.

The vest 77 and indicator rod 78 are independently useful for golf swing training. Since the indicator rod 78 traces the motion of the shoulders, the indicator rod 78 is capable of providing visual feedback reflecting the golfer's spine angle and swing motion. The indicator rod 78 is of sufficient length to be observable by the golfer's peripheral vision. The golfer G may therefore observe the indicator rod 78 for smoothness and consistency of motion along any desired path as the golfer practices the swing. If undesirable movements are made during the swing, the indicator rod provides visual feedback to the golfer G. Moreover, it is recognized that a superior golf swing is made when the golfer's arms remain close to the body during the swing. If the arms are pulled away from the body such a swing is referred to as a disconnected swing. The vest 77 and indicator rod 78 are useful to assist the golfer G to learn to keep the arms close to the body because an excessive raising of the arms (or of the leading arm) is restricted by the indicator rod 78. Thus, the vest 77 and indicator rod 78 provide an independent learning tool. One of ordeinary skill will appreciate that the rod 78 may be of reduced length for this purpose.

Figure 6:
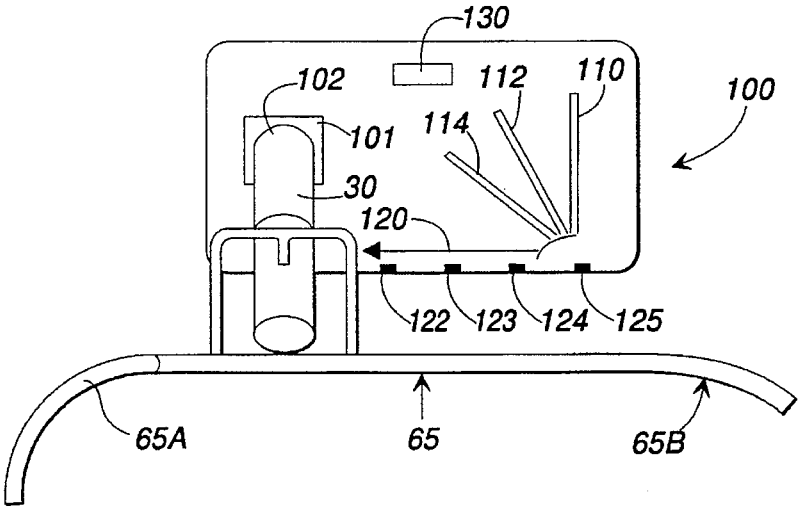
FIG. 6 is a plan view of a top surface of a base member in accordance with an alternative embodiment of the present invention.

Referring to FIG. 6, an alternative base member 100 is shown. Base member 100 provides a platform 101 with a mounting block 101 fitted with a female receptacle 102 that receives and supports the cylinder 30. Such support may be accomplished in any suitable manner. A friction fit of sufficient tolerance has been found to be adequate, although a locking mechanism (not shown) effected by rotation of the cylinder 30 within the receptacle 102 is suitable. The block 101 thus maintains the cylinder 30 and the guide loop 65. In this embodiment, the guide loop 65 is sectioned into two parts, 65A and 65B. Guide loop part 65A is curved and projects forwardly of guide loop part 65B. The construction of the cylinder 30, the guide loop 65 and the associated components is essentially identical to that already described hereinabove.

The base member 100 further includes shoulder rotation indicia 110, 112 and 114. These indicia correspond to the position of the indicator rod 78 along the guide loop 65. One of ordinary skill will appreciate that the indicia 110 is indicative of greater rotation than indicia 114. The base member 100 further includes an alignment arrow 120 and position markings 122, 123, 124 and 125. These indicia assist the golfer G with alignment to a desired target and stance width.

Figure 7:
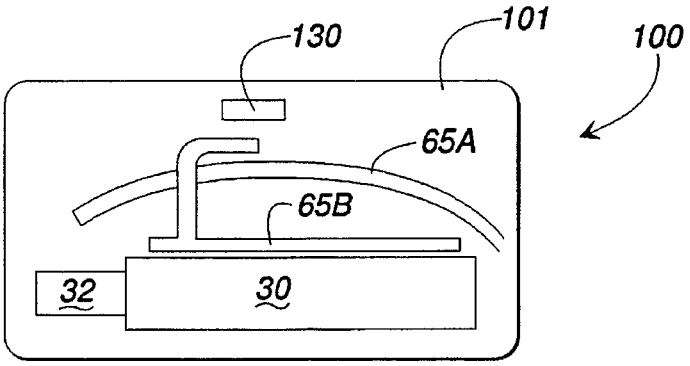
FIG. 7 is a plan view of the bottom of the base member in FIG. 6, showing the guide member and other component parts mounted for transport of the device.

FIG. 7 shows the back or bottom of the alternative base 101. The invention 10 has been broken down or collapsed, and secured to the backside of the base 101. By means of a handle 130, the base member bar may be readily picked up and carried. The component pieces (cylinder 30, guide loop 65, and the remaining components) may be attached in any suitable fashion, including by cooperating loops and hooks ("Velcro") or by cords that are attached to the base 100 and positioned to be looped about the component to hold them against the base 100.

It is to be understood that the above-described arrangements are simply illustrative of the invention. For example, in certain applications it may be deemed appropriate to provide two parallel guide members 65 and 65' (not shown) that provide yet additional information for the golfer G. The upper guide member 65' would indicate that the golfer G had excessively raised the shoulders or straightened the spine angle. Also, a forked indicator rod 78' may be provided that, at its distal end, is separated in a "Y" like manner to provide two segments. An upper segment sits above the guide member 65 and a lower segment rests below the guide member. The upper segment would readily indicate a reverse weight shift as described herein. The lower segment would serve as a physical restraint to preclude the golfer from excessive raising of the shoulders. Yet other arrangements may be devised by those skilled in the art which will embody the principles of the invention and fall within the spirit and scope thereof.

We claim:

1. A golf swing training device, comprising:

an indicator;

means for securing said indicator to a golfer so as to reflect the shoulder rotation of said golfer while making a golf swing, said indicator adapted to extend from said golfer in a direction substantially parallel to an axis passing through said golfer's shoulders and substantially perpendicular to an axis passing through said golfer's spine; and an adjustable guide adapted to be positioned adjacent said golfer for engagement with said indicator, said guide defining a path that reflects a proper shoulder turn to be made by said golfer such that, when said golfer makes a golf swing, said indicator traverses said guide.

2. The golf swing training device of claim 1 further comprising a sensing device operatively engaged with said indicator such that, if said indicator deviates from said guide while said golfer makes a golf swing, said sensing device detects such deviation; and means responsive to said sensing device for conveying the occurrence of a sufficient deviation of said indicator from said guide while said golfer is making a golf swing whereby, by repeatedly making said golf swing in such a manner as to cause said indicator to traverse said guide without sufficient deviation to activate said conveying means, said golfer learns the necessary muscle movement for execution of a proper shoulder turn.

3. The golf swing training device of claim 1 wherein said means for securing comprises an article to be worn by said golfer that is suitable for receipt of said indicator.

4. The golf swing training device of claim 2 further comprising a power source operatively associated with said sensing device, said power source being adapted to energize said sensing device and said conveying means.

5. The golf swing training device of claim 1 wherein said guide is supported by a base member including a plurality of indicia corresponding to a golfer's proper address position and degree of shoulder rotation.

6. The golf swing training device of claim 1 wherein said indicator and said guide are provided in sections such that said indicator and said guide may be readily broken down and transported.

* * * * *